United States Patent [19]

Gergoe

[11] Patent Number: 4,778,207

[45] Date of Patent: Oct. 18, 1988

[54] RELEASE HANDLE ASSEMBLY

[75] Inventor: Bela Gergoe, Birmingham, Mich.

[73] Assignee: General Motors Corporation, Detroit, Mich.

[21] Appl. No.: 91,635

[22] Filed: Sep. 1, 1987

[51] Int. Cl.[4] ..... E05C 21/02

[52] U.S. Cl. ..... 292/336.3; 292/DIG. 38; 292/DIG. 31; 292/347

[58] Field of Search ..... 292/DIG. 31, DIG. 63, 292/DIG. 38, 336–343, 347, 216, 280

[56] References Cited

U.S. PATENT DOCUMENTS

| | | | |
|---|---|---|---|
| 380,738 | 4/1888 | Bachman | 292/DIG. 63 X |
| 2,197,195 | 4/1940 | Schemers | 292/DIG. 63 X |
| 2,872,235 | 2/1959 | Brueder | 292/336.3 |
| 2,921,810 | 1/1960 | Smith | 292/DIG. 31 X |
| 3,606,428 | 9/1971 | Erch et al. | 292/336.3 |
| 3,666,308 | 5/1972 | Bonnaud | 292/336.3 |
| 4,198,084 | 4/1980 | Trotta | 292/DIG. 63 X |
| 4,268,077 | 5/1981 | Bohleen et al. | 292/DIG. 31 X |
| 4,580,822 | 4/1986 | Fukumoto | 292/DIG. 38 X |
| 4,703,963 | 11/1987 | Ball | 292/DIG. 63 X |

*Primary Examiner*—Richard E. Moore

*Attorney, Agent, or Firm*—Herbert Furman

[57] ABSTRACT

A release handle assembly for vehicle closure latches includes a release handle mounted within a recess of a housing for operation of a closure latch. A blocking member blocks insertion of the operator's fingers behind the handle when the closure latch is in locked position to provide the operator with a sensory indication of the position of the closure latch.

2 Claims, 1 Drawing Sheet

RELEASE HANDLE ASSEMBLY

This invention relates generally to release handle assemblies and more particularly to release handle assemblies for vehicle closure latches.

It is known to provide a release handle assembly on either the door inner panel or in the armrest of a vehicle door for actuation by the driver or passenger to release the closure latch of the door and permit the door to be opened. It is also known to provide closure latches of the uncoupling or free wheeling type wherein the release handle can be actuated even though the closure latch is in an uncoupled position or locked. In such latches, the driver or passenger does not know the latch is in an uncoupled position until the release handle is first actuated and the door remains in a closed and latched position.

The release handle assembly of this invention provides the operator, either the driver or passenger, with a sensory indication that the closure latch is in an uncoupled or locked position without actuation of the release handle.

In the preferred embodiment of the invention, an inside release handle is mounted within an outwardly opening recess of a housing mounted on the inside of a vehicle door. The handle closes a portion of the opening of the recess so that the operator must insert his or her fingers within the opening of the recess and behind the handle to operate the handle and release the closure latch through a connection between the release handle and the operating lever of the closure latch.

A blocking member is pivotally mounted within the recess for movement between blocking and unblocking positions. The blocking member is operatively connected to the locking means of the closure latch. When the locking means is in unlocked position, the blocking member is located adjacent an end wall of the recess and permits insertion of the operator's fingers past the blocking member and behind the release handle so that the closure latch can be released. When the locking means is in locked position, the blocking member is in blocking position and located across the area of the recess between the release handle and the base wall of the recess. The operator cannot insert his or her fingers behind the handle and the engagement of the operator's fingers with the blocking member gives the operator a sensory indication that the closure latch is in locked position.

The primary feature of this invention is that it provides a release handle assembly for vehicle closure latches which provides a sensory indication to the operator that the closure latch is in a locked position. Another feature is that the release handle assembly includes a release handle mounted within an outwardly opening recess of a housing and actuable by the operator through entry of his or her fingers behind the release handle, with the assembly further including blocking means movable between blocking and unblocking positions and operable in the former position to block entry behind the handle and provide the operator with a sensory indication of the condition of the closure latch through engagement of the operator's fingers with the blocking means. A further feature is that the blocking means includes a blocking member pivotally movable by the locking means of the closure latch between an unblocking position adjacent an end wall of the recess and a blocking position closing the space between the release handle and the base wall of the recess. Yet another feature is that the housing is formed of plastic material and includes integral pivots for the release handle and the blocking member.

These and other features will be readily apparent from the following specification and drawings wherein.

Figure 1:
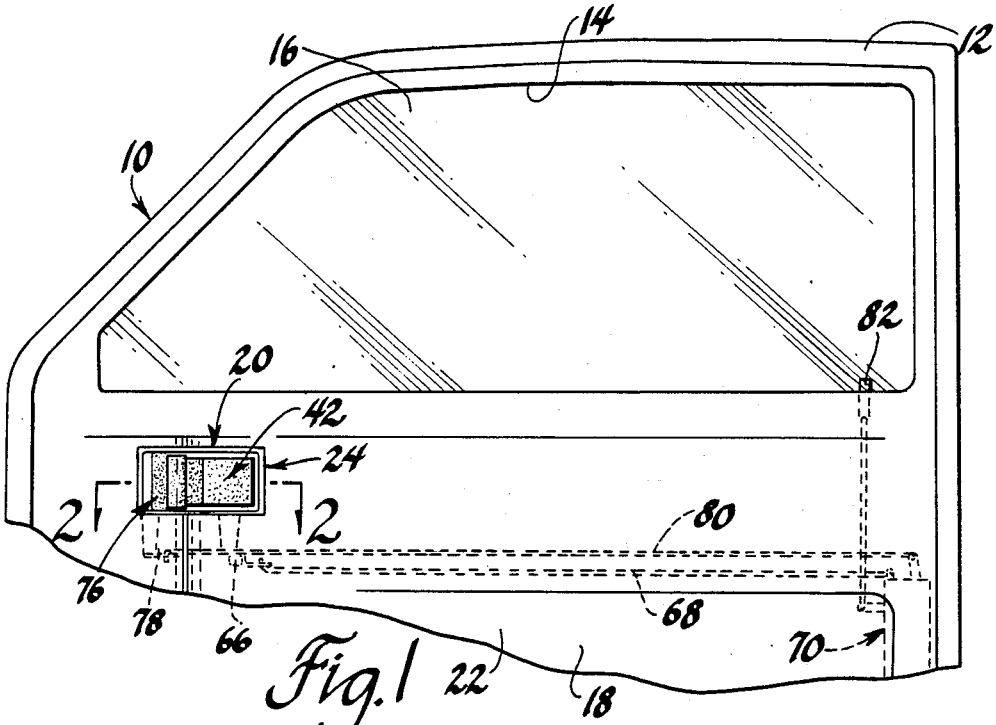
FIG. 1 is a partial view of a vehicle door embodying a release handle assembly according to this invention.

Referring now to FIG. 1 of the drawings, a righthand or passenger vehicle door 10 includes an upper door frame section 12 which provides a door window opening 14. A conventional door window 16 opens and closes the opening 14. The mechanism for raising and lowering the window 16 is housed within the lower section 18 of door 10 which conventionally includes spaced door inner and outer panels. A release handle assembly 20 according to this invention is mounted in the lower section 18 of door 10 on the inner panel 22 thereof.

Figure 2:
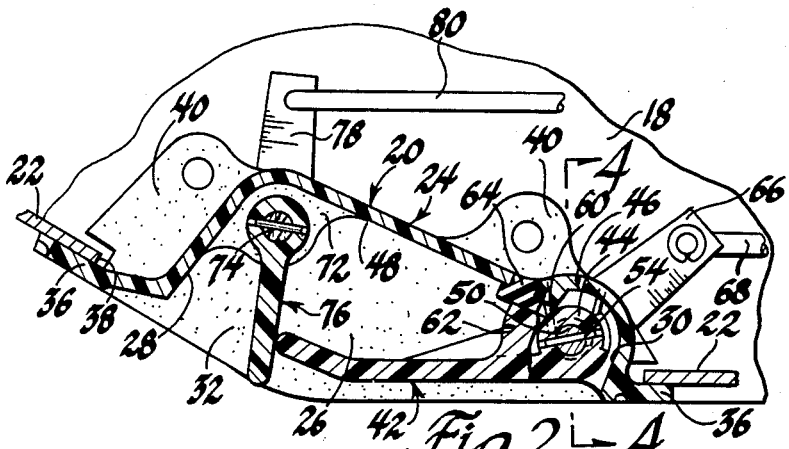
FIG. 2 is an enlarged sectional view taken on line 2—2 of FIG. 1 and showing the blocking member in blocking position.
Figure 3:
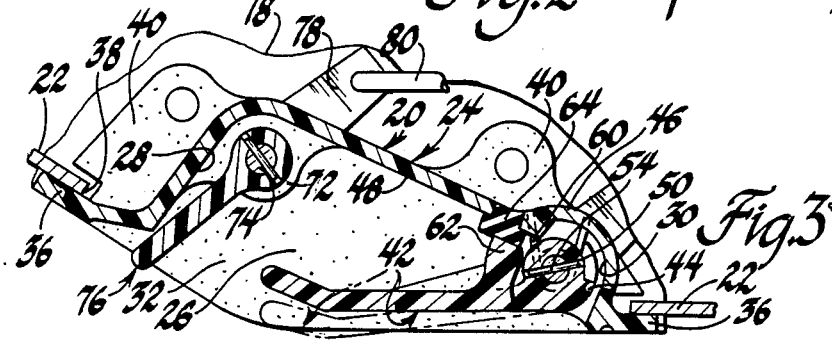
FIG. 3 is a view similar to FIG. 2 showing the blocking member in an unblocking position.
Figure 4:
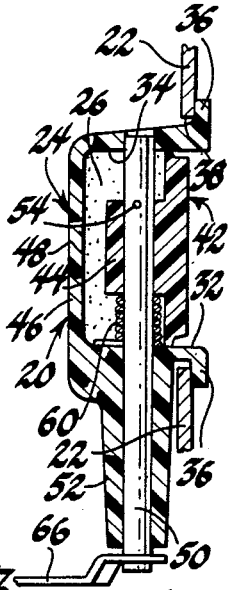
FIG. 4 is a sectional view taken on line 4—4 of FIG. 2.

As shown in FIGS. 2 through 4, the release handle assembly 20 includes a housing 24 of plastic material having a recess 26 defined by a forward end wall 28, a rearward end wall 30, a lower side wall 32, and an upper side wall 34. An integral terminal flange 36 of housing 24 overlies the panel 22 around an opening 38 therein. The housing 24 is mounted within the lower section 18 of door 10 in any suitable manner, such as by fasteners, not shown, through integral apertured ears 40 on the lower side wall 32 thereof.

A release handle 42 of plastic material is received within the opening of the recess 26 of housing 24. The handle includes an integral apertured boss 44 on the underside thereof fitting within a semi-cylindrical portion 46 of the base wall 48 of recess 26.

A pin 50 extends through boss 44, through openings in the side walls 32 and 34, and also through an apertured integral extension 52 of side wall 32. The boss 44 of handle 42 is pinned at 54 to the pin 50 to rotatably mount the handle within the recess 26 of the housing 24. A torsion spring 60 surrounds the pin 50 between the boss 44 and wall 32 and has one end engaged with boss 44 and the other end engaged in an opening in the base wall 48 of recess 26 to continually bias the handle 42 clockwise as viewed in FIGS. 2 and 3. The handle 42 is located in it normal inoperative position as shown in these Figures and against the bias of spring 60 by engagement of stop 62 of boss 44 with a resilient bumper 64 on the base wall 48 of recess 26. Pin 50 mounts a lever 66 on its lower end which is connected by a rod 68 to the inside operating lever of the closure latch 70 of door 10. Latch 70 forms no part of this invention and reference may be had to U.S. Pat. No. 4,585,261, Adams et al, Vehicle Closure Latch, issued Apr. 29, 1986 and assigned to the assignee of this invention for details of the latch. Latch 70 is an uncoupling type latch. The inside release lever of latch 70 releases the detent thereof through an operating lever.

Housing 24 further includes apertured aligned bosses 72 on walls 32 and 34 thereof. A pin 74 is rotatably mounted in these bosses and extends outwardly of the wall 34 through an extension which is the same as extension 52. A blocking member 76 is pinned to the pin 74 so as to rotatably mount the blocking member within the recess 26 for movement between a blocking position shown in FIG. 2 and an unblocking position shown in FIG. 3. The lower end of the pin 74 mounts a lever 78 which is connected by a rod 80 with the locking lever of the closure latch 70. When the locking lever is in locked position, it locates the blocking member 76 in its blocking position as shown in FIG. 2. When the locking lever is in its unlocked position, it locates the blocking lever 76 in its unblocked position shown in FIG. 3.

The locking lever of latch 70 is controlled conventionally through an inside garnish button 82 and an outside key cylinder, not shown.

When the blocking member 76 is in unblocked position as shown in FIG. 3, the operator can insert his or her fingers within the opening of recess 26, past the blocking member, and behind the release handle 42 so that the release handle can be moved outwardly of recess 26 to its operative position as indicated in dash lines in FIG. 3 to release the detent of the closure latch 70 and permit opening movement of door 10.

When the blocking member 76 is in its blocking position as shown in FIG. 2, the operator cannot insert his or her fingers behind handle 42. The engagement of the operator's fingers with the blocking member 76 will give the operator a sensory indication that the closure latch is in locked position and that the garnish button 82 must be operated to place the closure latch in unlocked position before the door can be opened. This prevents the wasted effort of the operator in free wheeling the release handle 42 before becoming aware of the position of the closure latch 70.

Thus this invention provides a release handle for a vehicle closure latch which provides the operator with a sensory indication of the position of the closure latch without actuation of the inside release handle.

The embodiments of the invention in Which an exclusive property or privilege is claimed are defined as follows:

1. In combination with a vehicle closure latch including latch means, operating means operable to release the latch means, and locking means movable between an unlocked position permitting release of the latch means upon operation of the operating means and a locked position preventing release of the latch means upon operation of the operating means, a release handle assembly for the closure latch comprising, a housing including an outwardly opening recess, a release handle mounted to the housing, means locating the release handle within the opening of the recess in the normal inoperative position thereof, the release handle partially closing the opening of the recess to provide space for entry of an operator's fingers within the recess behind the handle to move the handle between the inoperative position thereof and an operative position outwardly of the opening of the recess by the operator's fingers, means operatively connecting the release handle to the operating means of the closure latch for release of the latch means upon movement of the release handle to the operative position, blocking means mounted to the housing for movement between a blocking position wherein the blocking means blocks entry of the operators fingers behind the handle and an unblocking position wherein the blocking means permits such entry, and means coupling the blocking means to the locking means of the closure latch for moving the blocking means to blocking position upon movement of the locking means to locked position, the engagement of the operators fingers with the blocking means providing a sensory indication to the operator that the locking means of the closure latch is in locked position and the latch means cannot be released.

2. In combination with a vehicle closure latch including latch means, operating means operable to release the latch means, and locking means movable between an unlocked position permitting release of the latch means upon operation of the operating means and a locked position preventing release of the latch means upon operation of the operating means, a release handle assembly for the closure latch comprising, a housing including an outwardly opening recess defined by side walls, end walls, and a base wall, a release handle mounted to the housing, means locating the release handle within the opening of the recess in the normal inoperative position thereof, the release handle partially closing the opening of the recess to provide space for entry of an operator's fingers within the recess behind the handle to move the handle between the inoperative position thereof and an operative position outwardly of the opening of the recess by the operator's fingers, means operatively connecting the release handle to the operating means of the closure latch for release of the latch means upon movement of the release handle to the operative position, a blocking member mounted between the side walls of the housing for movement between a blocking position wherein the blocking member blocks entry of the operators fingers behind the handle and an unblocking position adjacent one end wall wherein the blocking member permits entry of the operator's fingers past the blocking member and behind the handle, and means coupling the blocking member to the locking means of the closure latch for moving the blocking member to blocking position upon movement of the locking means to locked position, the engagement of the operators fingers with the blocking member providing a sensory indication to the operator that the locking means of the closure latch is in locked position and the latch means cannot be released.

* * * * *